US007997181B1

(12) United States Patent
Tunis et al.

(10) Patent No.: US 7,997,181 B1
(45) Date of Patent: Aug. 16, 2011

(54) HARD COMPONENT LAYER FOR BALLISTIC ARMOR PANELS

(75) Inventors: George C. Tunis, Berlin, MD (US); Scott Kendall, Berlin, MD (US); Stephen L. Kinnebrew, Crisfield, MD (US)

(73) Assignee: Hardwire, LLC, Pocomoke, MD (US)

( * ) Notice: Subject to any disclaimer, the term of this patent is extended or adjusted under 35 U.S.C. 154(b) by 212 days.

(21) Appl. No.: 12/316,255

(22) Filed: Dec. 10, 2008

Related U.S. Application Data

(60) Provisional application No. 61/005,969, filed on Dec. 10, 2007.

(51) Int. Cl.
*F41H 5/04* (2006.01)

(52) U.S. Cl. ..... 89/36.02; 89/904; 89/908; 89/914; 89/917

(58) Field of Classification Search ..... 89/36.02, 89/904, 908, 914, 917
See application file for complete search history.

(56) References Cited

U.S. PATENT DOCUMENTS

| | | | | |
|---|---|---|---|---|
| 5,340,633 | A | 8/1994 | van der Loo et al. | |
| 5,996,115 | A * | 12/1999 | Mazelsky | 2/2.5 |
| 2004/0083880 | A1 * | 5/2004 | Cohen | 89/36.02 |
| 2007/0125223 | A1 * | 6/2007 | Heidenreich et al. | 89/36.02 |
| 2009/0280708 | A1 * | 11/2009 | Marissen et al. | 442/181 |
| 2009/0320675 | A1 * | 12/2009 | Landingham et al. | 89/36.02 |

* cited by examiner

*Primary Examiner* — Stephen M Johnson
(74) *Attorney, Agent, or Firm* — Weingarten, Schurgin, Gagnebin & Lebovici LLP

(57) ABSTRACT

A multi-layer ballistic or armor panel system includes a hard component strike layer that is a continuous planar assembly of tile elements, the planar assembly having a strike surface and a rear surface. Seams between the tile elements are substantially non-perpendicular to the strike surface, thereby tending to deflect incoming projectiles. Grooves may be formed in one or more of the strike surface and the rear surface of the tile elements to provide a preferential weakness. The armor panel system may also include a reinforcing layer on at least one of the strike surface and the rear surface. A backing layer may be provided after the rear surface.

11 Claims, 9 Drawing Sheets

HARD COMPONENT LAYER FOR BALLISTIC ARMOR PANELS

CROSS REFERENCE TO RELATED APPLICATIONS

This application claims priority under 35 U.S.C. §119(e) to U.S. Provisional Patent Application No. 61/005,969, filed on Dec. 10, 2007, the disclosure of which is incorporated by reference herein.

STATEMENT REGARDING FEDERALLY SPONSORED RESEARCH OR DEVELOPMENT

This invention was made with Government support under Agreement No. HR0011-6-9-0008 awarded by DARPA. The Government has certain rights in the invention.

BACKGROUND OF THE INVENTION

Ballistic and blast resistant armor panels are well known and take on a variety of configurations for providing armor to buildings, vehicles, ships, airplanes and a variety of other applications where armor is required. In addition to typical projectiles, it is also desirous to stop high velocity armor piercing weapons.

Most armor piercing projectiles rely on a hard material in a pointed rod-like form (e.g. hardened steel, tungsten carbide). The point of the armor piercing element or penetrator develops very high stress on contact, while the hard nature of the penetrator material allows it to maintain high stress without failing, causing the target to fail (crush, deform, melt, or vaporize). Further, the long rod-like shape allows a large amount of kinetic energy to be applied to a small area.

One method used to defeat an armor piercing threat is to use a hard surface to blunt, crack, and/or fragment the projectile so that it can then be stopped more easily. For example, a ceramic may be used as the first surface, with a metal such as aluminum as the second layer, and a composite material laminate as a layer to catch the fragments.

Attempts have been made to facilitate deflection (and rotation) of projectiles. Examples include an array of ceramic balls, in two or more non-aligned layers, to create a somewhat torturous path for the penetrator, in which it is not possible to find a straight path that intersects a ball surface at an angle. The balls need to be of substantial weight in comparison to the projectile in order to have a significant effect, and such weight is not efficient.

Another design uses short ceramic cylinders with rounded ends, suspended in a soft matrix, but suffers similar shortcomings as the array of balls. Other attempts include a wavy surface, with peaks and valleys, some with a spherical indentation in a square ceramic tile, to thicken the tile in the corners and try to offer non-flat surfaces. All of these attempts have fallen short of providing the glancing effect at all positions on a panel and at all trajectory angles. There is always a way to hit the panel at 90° to the primary stopping interface, at some position and angle.

In U.S. Pat. No. 5,007,326, metal layers with holes present oblique surfaces to the projectile in an effort to break up the projectile.

SUMMARY OF THE INVENTION

In one embodiment, an armor panel system has a projectile-deflecting section formed of tile elements having angled seams. The angled seams help to deflect incoming projectiles.

In another embodiment, a component layer of an armor panel system includes at least one groove in one or more surfaces. The grooves provide preferential weakness to the component layer, helping to limit the damage zone to a smaller area.

DESCRIPTION OF THE DRAWINGS

The invention will be more fully understood from the following detailed description taken in conjunction with the accompanying drawings in which.

DETAILED DESCRIPTION OF THE INVENTION

This application claims priority under 35 U.S.C. §119(e) to U.S. Provisional Patent Application No. 61/005,969, filed on Dec. 10, 2007, the disclosure of which is incorporated by reference herein.

Figure 1:
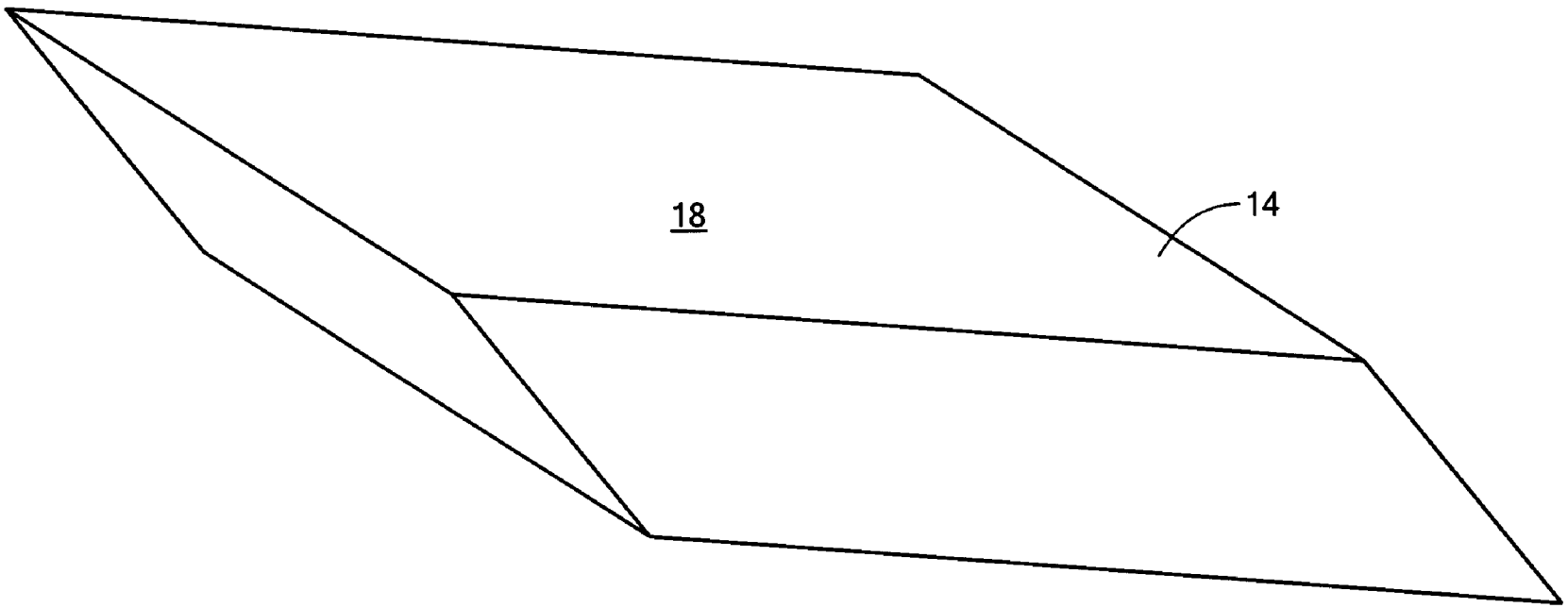
FIG. 1 is an isometric view of a tile element having angled seams for a hard component layer of a ballistic panel system according to the present invention.
Figure 2A:
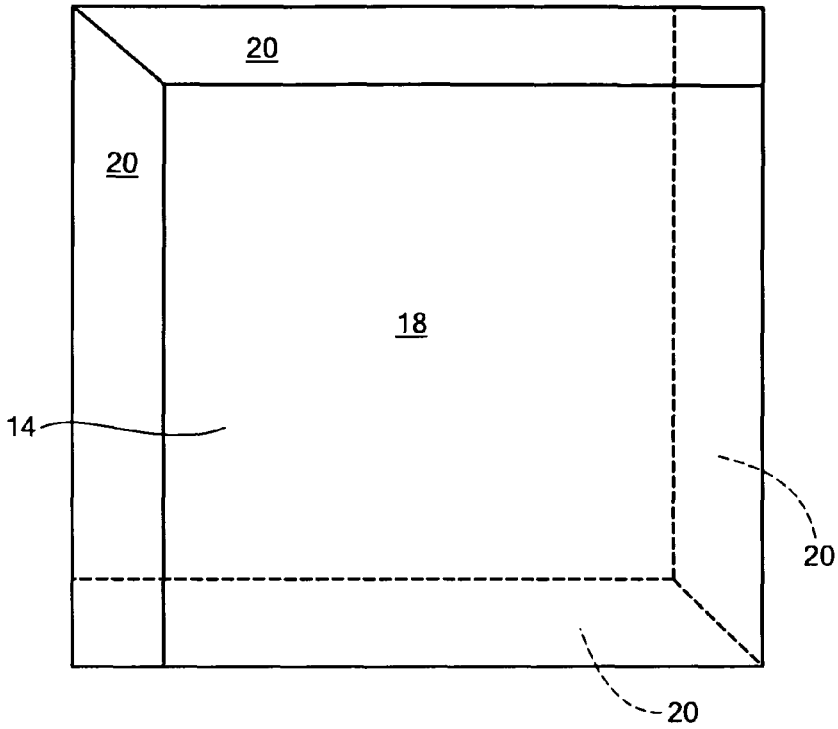
FIG. 2A is a plan view of the tile element of FIG. 1.
Figure 2B:
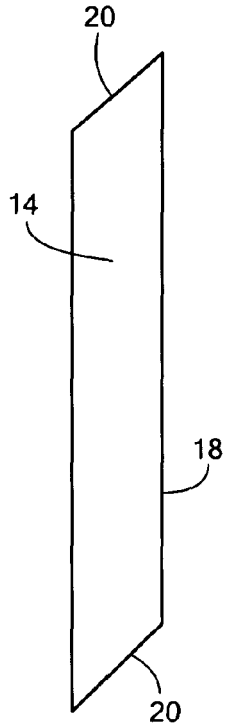
FIG. 2B is a side view of the tile element of FIG. 2A.
Figure 2C:
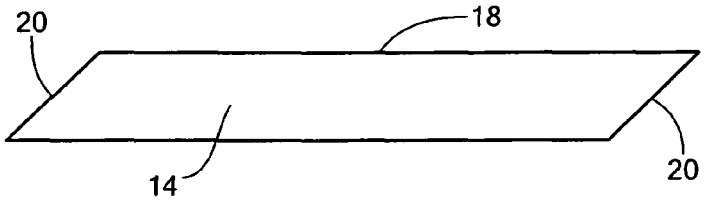
FIG. 2C is an end view of the tile element of FIG. 2A.
Figure 4:
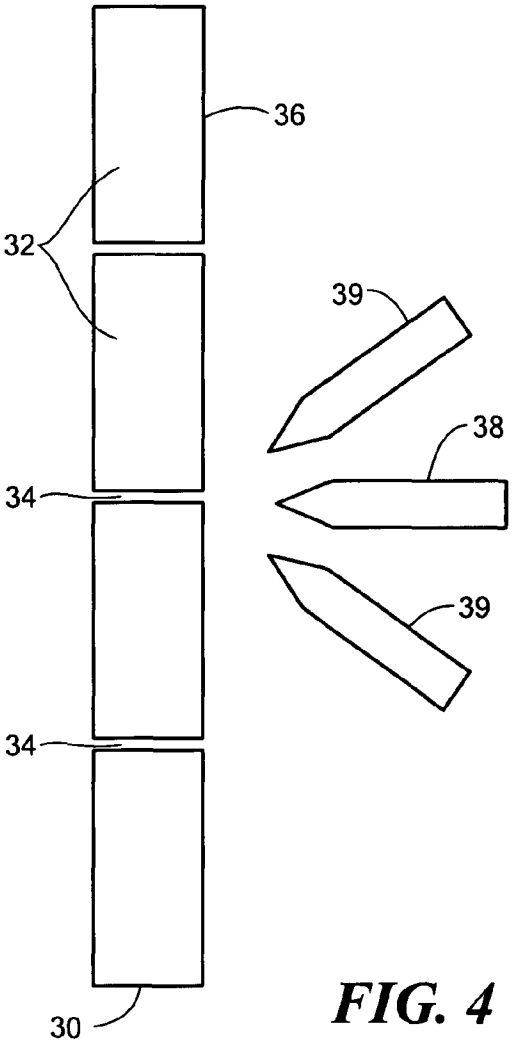
FIG. 4 is a side view of a planar assembly of tile elements having perpendicular seams.
Figure 3:
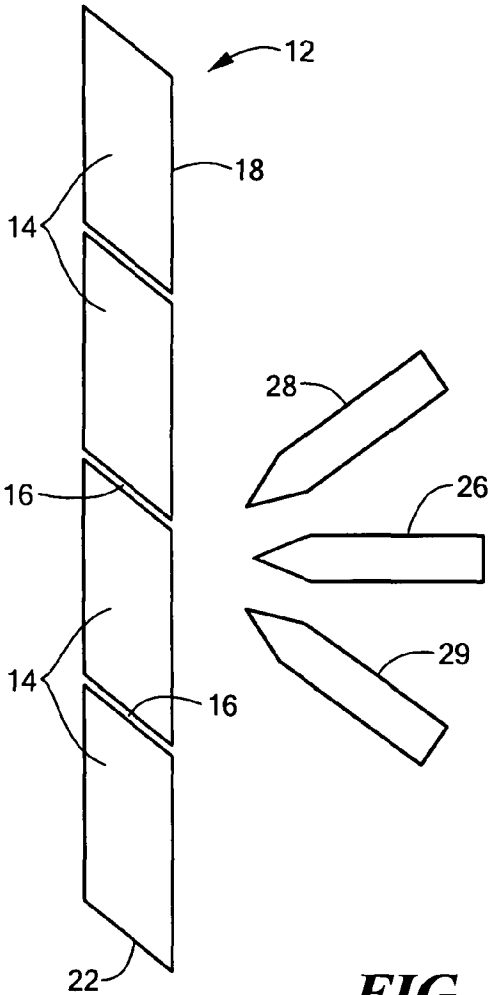
FIG. 3 is a side view of a planar assembly of tile elements according to FIG. 1.
Figure 5B:
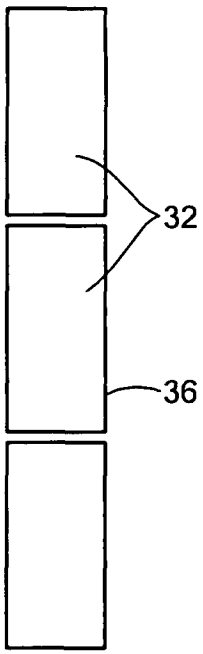
FIG. 5B is a side view of the planar assembly of FIG. 5A.
Figure 5A:
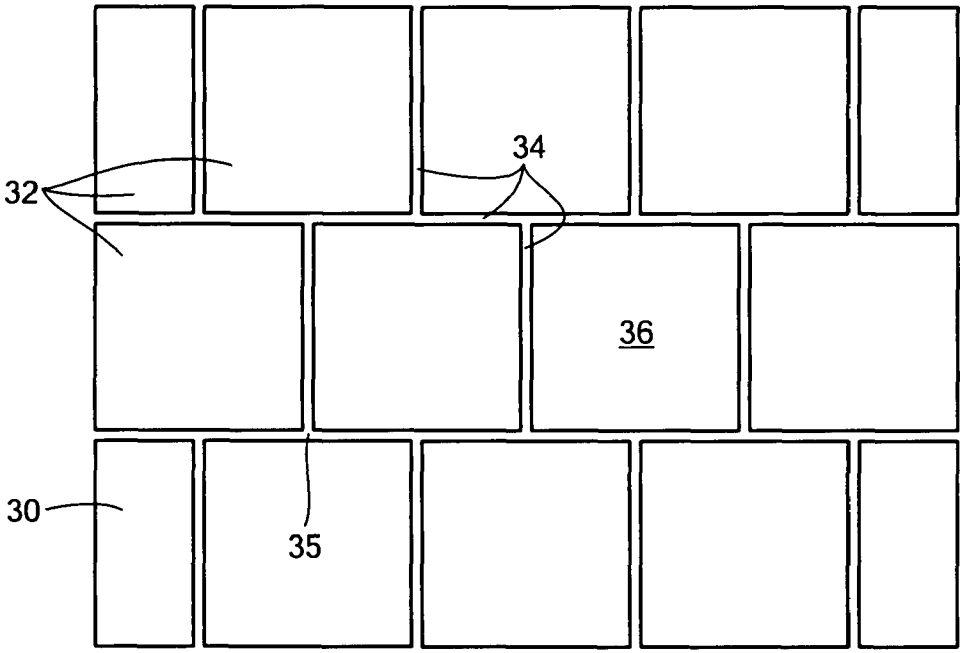
FIG. 5A is a plan view of the planar assembly of FIG. 4.
Figure 5C:
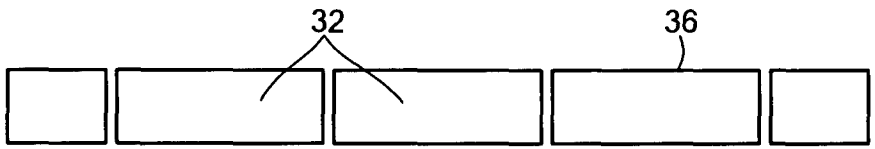
FIG. 5C is an end view of the planar assembly of FIG. 5A.

Referring to FIGS. 1-3, an armor or ballistic panel system is formed with a planar assembly 12 of ballistic tiles or tile elements 14 in which the seams 16 between the tiles are not perpendicular to the primary or strike surface 18 of the tiles. The seams are formed by edge surfaces 20 of the tiles formed at an angle less than 90° to the primary surface 18. When the tiles are arranged in the planar assembly, the edge surfaces 20 of adjacent tiles abut closely, and the seams 16 mate tightly without gaps. (For clarity, gaps between tile elements are exaggerated in FIG. 3.) If desired, a thin bonding layer of an adhesive, such as an epoxy or other liquid resin, may be included between the edge surfaces, for example, to fill imperfections. Preferably, the seams are angled 10°-60° from perpendicular to the primary surface. The tile elements can be formed from a variety of suitable hard materials, such as steel, granite, glass, or ceramic. An alumina ceramic is one preferred material.

Figure 6:
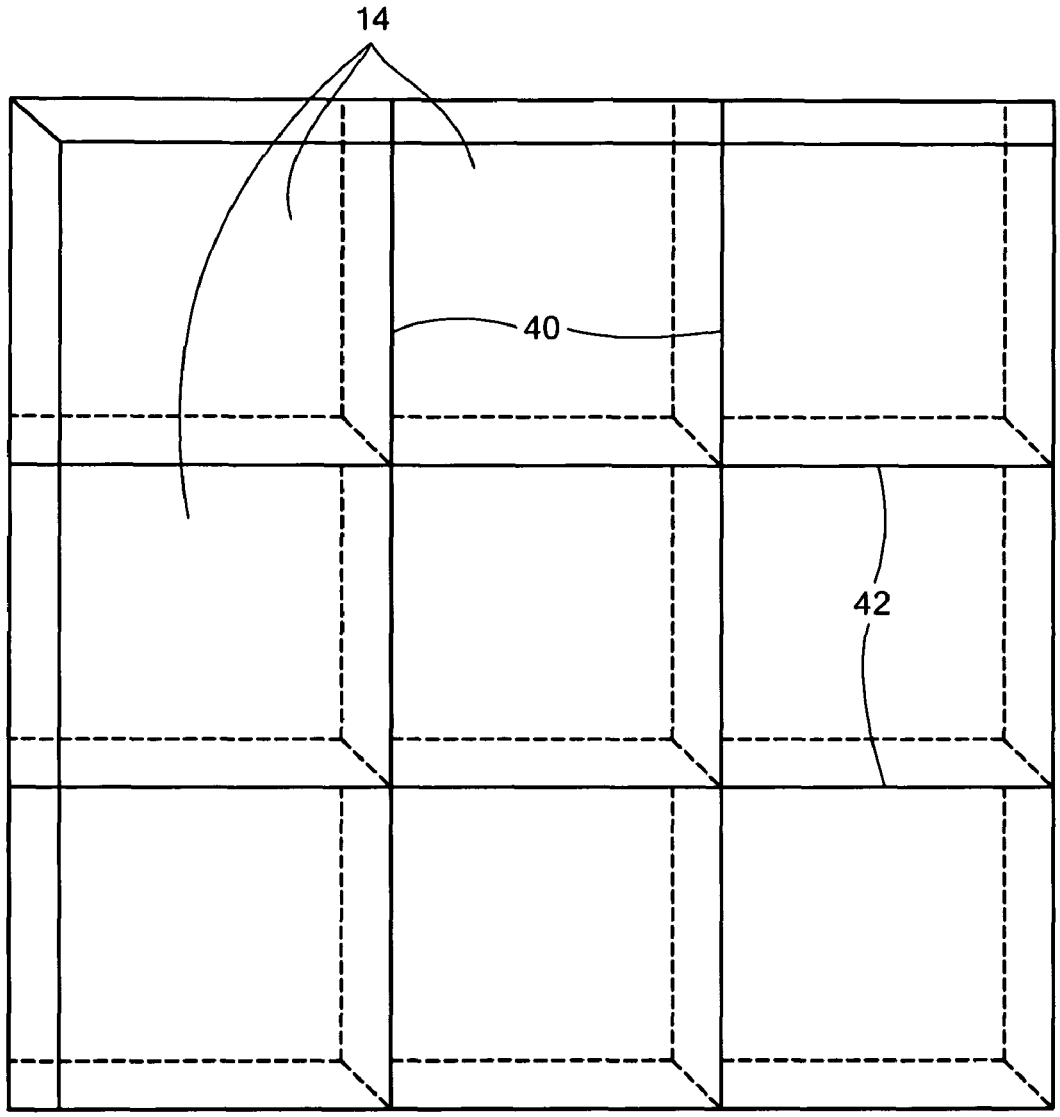
FIG. 6 is a plan view of a planar assembly illustrating one embodiment of a tile pattern.
Figure 7:
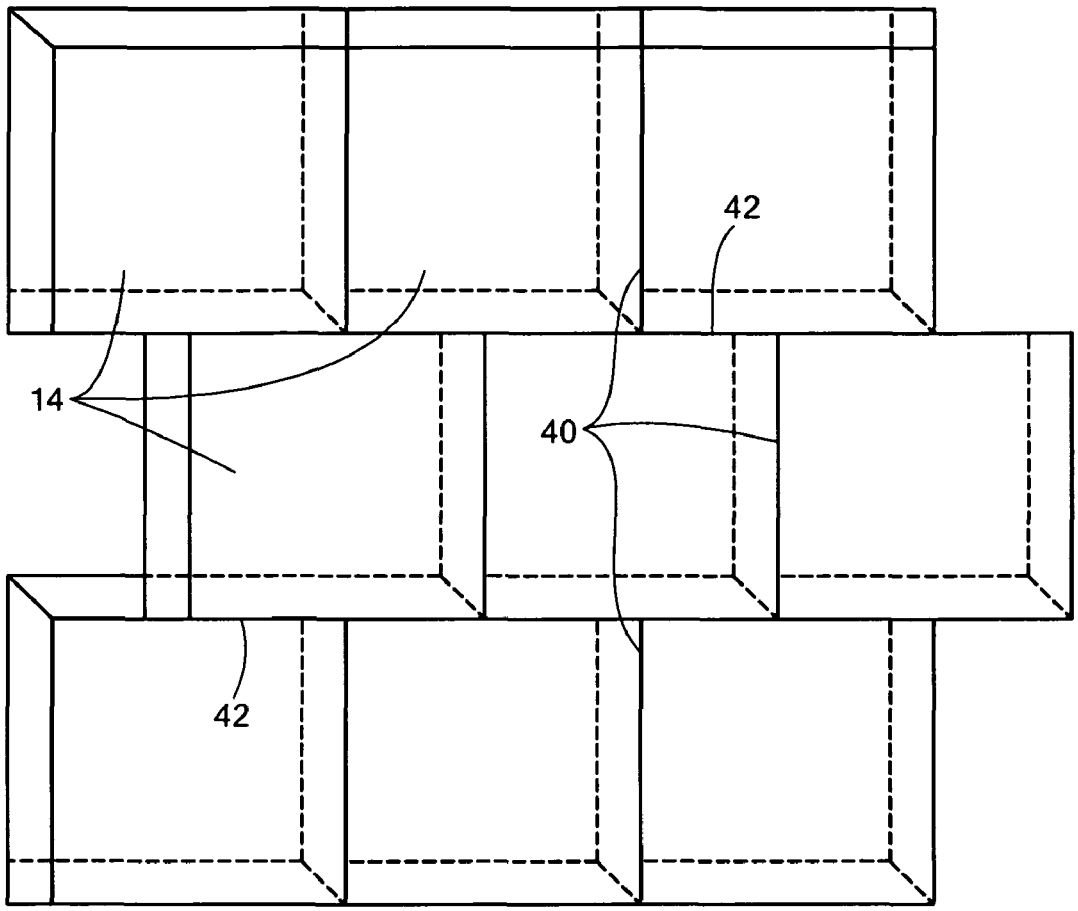
FIG. 7 is a plan view of a planar assembly illustrating a further embodiment of a tile pattern.

The planar assembly 12 of tile elements 14 preferably forms a hard component layer 22, the primary strike layer, in a multi-layer panel. (See, for example, FIG. 11, described further below.) Layers behind the strike layer can, for example, function as a catcher layer to capture projectile fragments. The strike layer can also be reinforced on its front and back surfaces. When arranged in an armor panel, the primary face of the tile elements can have a variety of shapes, such as square, rectangular, triangle, hexagonal, octagonal. In one preferred embodiment, the tile elements have a parallelepiped shape (FIG. 1). The tile elements can be arranged in a variety of patterns. FIG. 6 illustrates a pattern in which the seams 40, 42 between rows and columns of square-faced tile elements are continuous in both directions, and FIG. 7 illustrates a pattern in which the seams 40 in one direction are staggered.

The worst condition for an armor panel is usually when a projectile threat 26 hits at 90° to the surface 18. When a projectile 28 hits at an angle less than 90°, a redirecting or glancing effect tends to rotate the projectile. If the angle is sufficiently low, the projectile may bounce off or ricochet from the surface. Thus, if the penetrator can be redirected or turned sideways somewhat, so that its primary axis is no longer parallel with its initial trajectory, it may be stopped more easily, and in a more conventional manner. For example, multi-layer materials and orthotropic materials have been determined to continue to create asymmetrical loads tending to rotate the projectile, as long as it is moving through the material at an angle to the layers, or in the case of an orthotropic material, at an angle to one or more of the planes of material symmetry. (As used herein, orthotropic materials are generally considered to be anisotropic materials, which are further classified to have three mutually perpendicular planes of material symmetry. The term macroscopically orthotropic is used to describe an assembly of materials that may be isotropic in themselves, but the assembly behaves in an orthotropic manner when viewed at a large enough scale.) See U.S. patent application Ser. No. 12/288,443, filed Oct. 20, 2008.

The angled seams 16 provide a similar effect of rotating the projectile by eliminating the weak zone normally associated with perpendicular seams. The angled seams provide a deflecting plane tending to perturb or rotate the trajectory of an armor piercing projectile. The angled seams can create the perturbing or rotating effect in a small envelope, reducing the thickness of the panel. The smaller the thickness of the panel is, the more readily the panel can be integrated into a vehicle or structure.

A planar assembly 30 incorporating tiles 32 having tile seams 34 that are perpendicular to the primary surface or strike surface 36 is illustrated in FIGS. 4 and 5A-5C. The perpendicular seams offer a weakened path, and the corners 35 where two tiles meet, called a "triple point," are weaker than the main body of the tile. The perpendicular seams 34 are particularly vulnerable to projectiles 38 at 90° to the surface. Projectiles 39 at oblique angles, to either side of 90°, have difficulty exploiting the seam weakness, because the angled surface serves to rotate and disrupt the projectile's trajectory.

Referring again to FIG. 3, the seams 16 are not perpendicular to the primary surface 18. Projectiles 26 at 90° are more readily defeated. Projectiles 28 at greater angles relative to the seams also have difficulty exploiting the seam weakness. Projectiles 29 at lower angles relative to the seam, including those directly lined up with the seam, also have difficulty exploiting the weakness, because they are already oblique to the primary surface 18 and can more readily be captured in catcher layers behind the tile strike layer.

Figure 8:
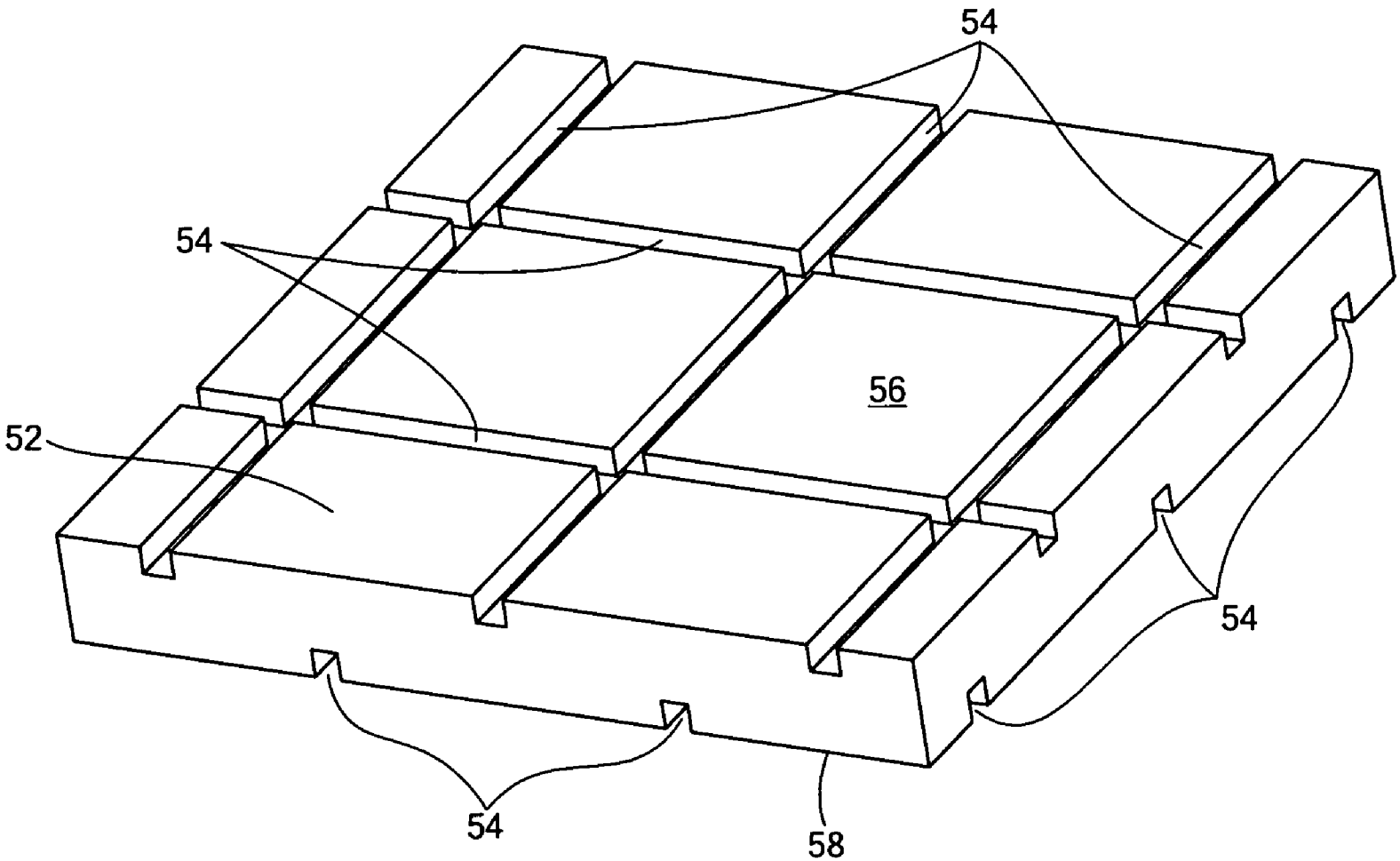
FIG. 8 is an isometric view of a further embodiment of a tile element having grooves in strike and rear surfaces according to the present invention.

In another embodiment of the invention, a component layer in a ballistic panel system includes at least one groove in one surface. Preferably the component layer is a planar assembly of tile elements. A single tile element 52 with grooves 54 is illustrated in FIG. 8. The grooves provide preferential weakness to the component layer. They help to limit the damage zone to a smaller area, providing improved multi-hit capability. The grooves also allow small sections of tile elements to move and/or rotate and perturb the trajectory of the projectile.

The grooves 54 can be provided on one or both surfaces 56, 58. Preferably the grooves in a single direction are staggered from one surface to the other so they do not line up. Grooves can also be provided in more than one direction on a single surface. In FIG. 8, the grooves are mutually orthogonal, although other directions can be provided. The grooves can be parallel or perpendicular to an edge or at a non-parallel, non-perpendicular angle to an edge. The grooves can be continuous from one tile element to an adjacent tile element, or the grooves can be staggered.

The grooves can have any suitable cross-section, such as rectangular or V-shaped. The groove depth can be 5-90% of the tile thickness. The grooves are preferably 0.25 to 5 mm wide. The grooves can be provided on tile elements incorporating the angled seams, such as described above, or the grooves can be provided on tile elements with perpendicular seams. The grooves can also be provided on other hard component layers of ballistic panels.

Figure 9:
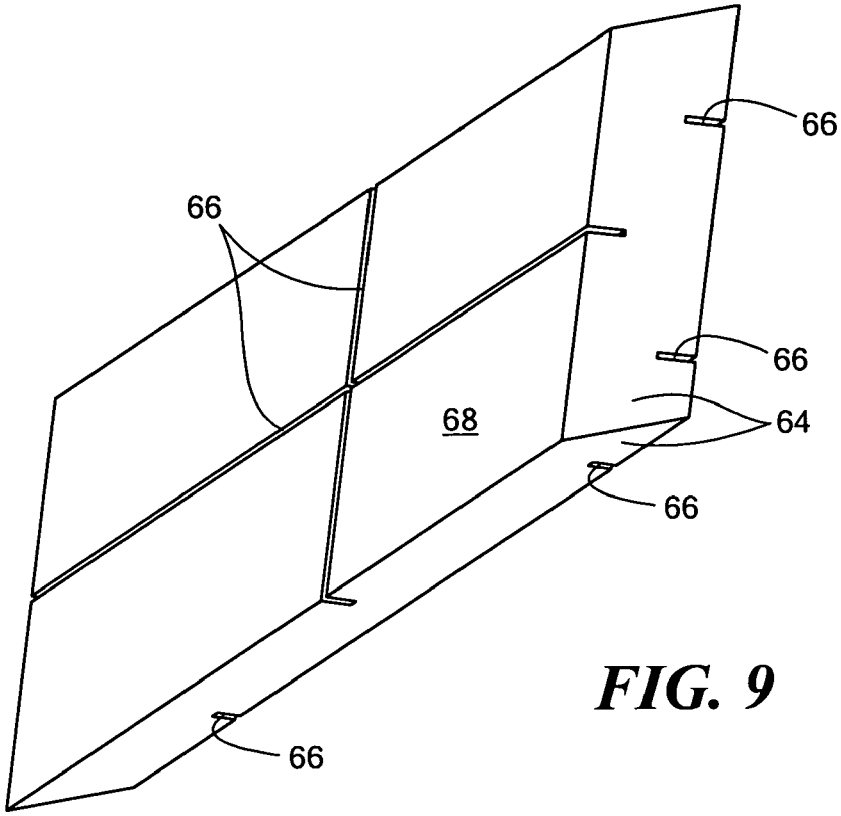
FIG. 9 is a front isometric view of a still further embodiment of a tile element having grooves and angled edges.
Figure 10:
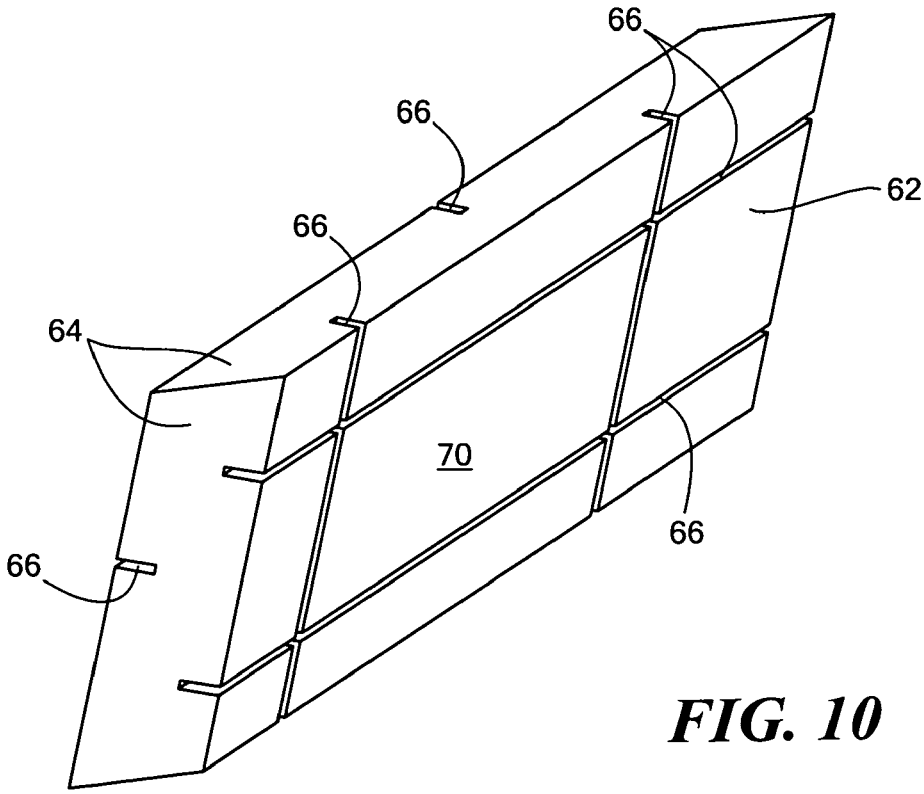
FIG. 10 is a back isometric view of the tile element of FIG. 9.

One exemplary embodiment of a tile element 62 incorporating both angled edges 64 and grooves 66 is illustrated in FIGS. 9 and 10. In this example, the tile element is 4"×4"×12 mm, with 30° angled edges. The grooves are 1 mm wide×4 mm deep. The grooves are in a cross pattern, two on one surface 68, and four on the other surface 70. The grooves are offset so they are staggered from one surface of the tile element to the other.

Figure 11:
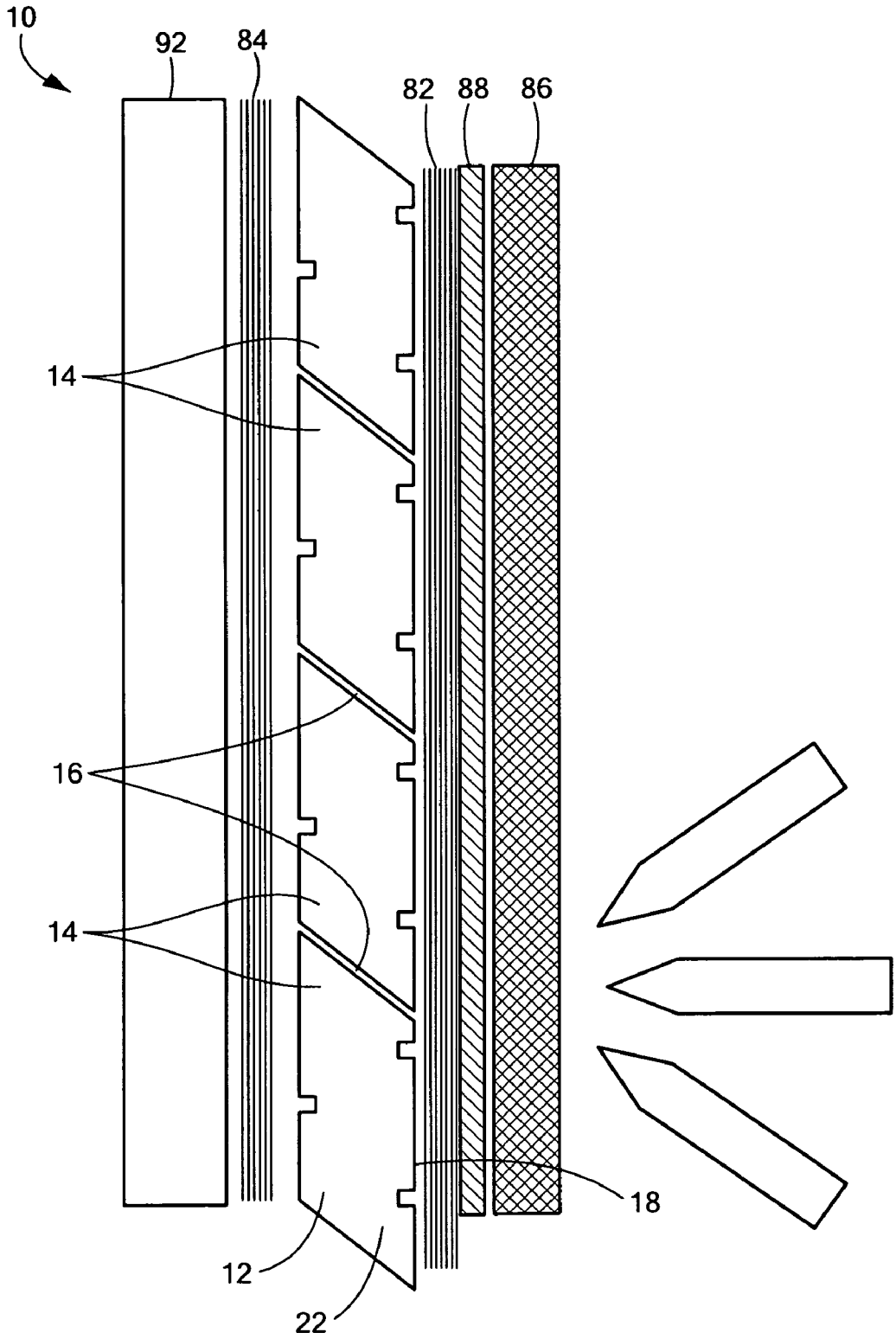
FIG. 11 is an exploded schematic side view of a ballistic panel system incorporating the tile element of FIGS. 9 and 10.

Preferably, a planar assembly 12 of tile elements 14 forms one component layer 22 in a multi-layer ballistic panel 10, as illustrated in FIG. 11. In this example, the tile elements are as shown and described above in conjunction with FIGS. 9 and 10. The planar assembly 12 of tile elements can be reinforced on one or both sides with additional layers 82, 84 of reinforcing material. The reinforcing material can be a composite material, such as fiberglass, aramid (such as KEVLAR®), carbon, or steel fiber in a plastic resin. The plastic resin can be epoxy, urethane, or polyester. The reinforcing material can be provided in layers in a 0°/90° configuration. HARDWIRE° reinforcing material is a suitable commercially available steel wire reinforcing material.

A plastic surface layer 86 is bonded to the reinforced strike surface 18 of the tile elements 14. The surface layer may be 0.05" to 1" thick. Suitable plastic materials include acrylonitrile butadiene styrene (ABS), polycarbonate, polyethylene, polypropylene, or urethane. A suitable bonding material is a layer 88 of methacrylate adhesive, urethane, epoxy, or polyester.

Also, a composite laminate 92 is provided as a backing. The composite laminate is preferably alternating 0°/90° layers of unidirectional ultra high molecular weight polyethylene fiber in a urethane matrix, available commercially as DYNEEMA°, pressed into a laminate. The laminate may be 0.25" to 2" thick. The composite laminate can also be formed of glass, aramid (such as) KEVLAR®, carbon, or steel fibers in a plastic resin. Suitable plastic resins include epoxy, urethane, or polyester resins.

The invention is not to be limited by what has been particularly shown and described, except as indicated by the appended claims.

What is claimed is:

1. A multi-layer ballistic or armor panel system comprising:

an assembly of materials comprising:

a component strike layer comprised of a continuous planar assembly of tile elements, the planar assembly having a strike surface and a rear surface, wherein seams between the tile elements are substantially non-perpendicular to the strike surface, the seams between tile elements in one row are staggered from the seams between tile elements in an adjacent row;

the tile elements have a plurality of grooves in the strike surface and a plurality of grooves in the rear surface, wherein the grooves in the strike surface are staggered or offset from the grooves in the rear surface;

a reinforcing material on the strike surface and on the rear surface, the reinforcing material comprising layers of a composite material comprised of fibers in a plastic resin, the layers arranged in a 0°/90° configuration on the strike surface and on the rear surface;

a plastic surface layer bonded to the reinforcing material on the strike surface of the hard component strike layer; and a backing layer adjacent to the reinforcing material on the rear surface of the hard component strike layer, the backing layer comprising a composite material laminate comprised of alternating 0°/90° layers of unidirectional polyethylene fibers in a urethane matrix.

2. The system of claim 1, wherein the seams are angled at least 10° from perpendicular to the strike surface.

3. The system of claim 1, wherein the seams are angled from 10 to 60° from perpendicular to the strike surface.

4. The system of claim 1, wherein the seams mate tightly.

5. The system of claim 1, wherein the tile elements are comprised of steel, granite, glass, ceramic, or alumina ceramic.

6. The system of claim 1, wherein each tile element has a parallelepiped shape.

7. The system of claim 1, wherein each tile element has a polygonal shape in plan view.

8. The system of claim 7, wherein the polygonal shape comprises a square, rectangle, triangle, hexagon, or octagon.

9. The system of claim 1, wherein the groove has a rectangular or V-shaped cross-section.

10. The system of claim 1, wherein the groove has a depth that is 5 to 90% of the tile element thickness.

11. The system of claim 1, wherein the groove has a width of 0.25 to 5 mm.

* * * * *

UNITED STATES PATENT AND TRADEMARK OFFICE

CERTIFICATE OF CORRECTION

PATENT NO. : 7,997,181 B1
APPLICATION NO. : 12/316255
DATED : August 16, 2011
INVENTOR(S) : George C. Tunis et al.

It is certified that error appears in the above-identified patent and that said Letters Patent is hereby corrected as shown below:

Column 4, line 39, "HARDWIRE°" should read --HARDWIRE®--; and

Column 4, line 53, "DYNEEMA°" should read --DYNEEMA®--.

Signed and Sealed this
Eighth Day of May, 2012

David J. Kappos

David J. Kappos
*Director of the United States Patent and Trademark Office*